US006152187A

United States Patent [19]

Lindblom

[11] Patent Number: 6,152,187

[45] Date of Patent: Nov. 28, 2000

[54] HEALD FRAME WEAVING MACHINE FOR FORMING STRENGTHENED TUBULAR-WOVEN PRODUCTS

[75] Inventor: Bo Lindblom, Osby, Sweden

[73] Assignee: Texo AB, Almhult, Sweden

[21] Appl. No.: 09/336,983

[22] Filed: Jun. 21, 1999

[30] Foreign Application Priority Data

Aug. 31, 1998 [SE] Sweden ..... 9802916

[51] Int. Cl.[7] ..... D21F 1/12; D21F 1/00

[52] U.S. Cl. ..... 139/11; 28/142; 162/904; 139/383 AA

[58] Field of Search ..... 139/1 R, 383 AA, 139/388, 425 A, 438; 442/206; 162/904; 28/142; 428/57

[56] References Cited

U.S. PATENT DOCUMENTS

| | | | |
|---|---|---|---|
| 1,513,506 | 10/1924 | Holt et al. . | |
| 2,672,169 | 3/1954 | Walters | 139/388 |
| 2,903,021 | 9/1959 | Holden et al. . | |
| 3,727,647 | 4/1973 | Laval | 139/438 |
| 3,815,645 | 6/1974 | Codorniu | 139/383 AA |
| 4,410,015 | 10/1983 | Koller et al. . | |
| 4,658,863 | 4/1987 | Errecart . | |
| 4,771,814 | 9/1988 | Quigley . | |
| 5,360,038 | 11/1994 | Sano . | |
| 5,411,063 | 5/1995 | Hacker et al. . | |
| 6,000,441 | 12/1999 | Lee et al. | 139/383 AA |

FOREIGN PATENT DOCUMENTS

| | | |
|---|---|---|
| 0236601 | 9/1987 | European Pat. Off. . |
| 0502635 | 9/1992 | European Pat. Off. . |
| 0597495 | 5/1994 | European Pat. Off. . |
| 1066975 | 4/1967 | United Kingdom . |

*Primary Examiner*—Andy Falik
*Attorney, Agent, or Firm*—Pollock, Vande Sande & Amernick, R.L.L.P.

[57] ABSTRACT

A weaving machine arrangement includes a heald frame weaving machine and, arranged on both sides of the latter, two sets of accessory equipment. The warp thread set of the heald frame weaving machine is divided into a first set and second and third warp thread sets. The second and third warp thread sets are used in order to form extended turning-fold areas in the tubular-woven material. The accessory equipment forms patterns for the terminating positions of the weft threads in these areas, strong seaming functions are obtained in the tubular-woven material. Cut-off thread ends are anchored by heat action. The degree of automation is increased in relation to conventional manufacturing by virtue of the fact that the seaming function can be carried out in the heald frame weaving machine itself.

6 Claims, 9 Drawing Sheets

HEALD FRAME WEAVING MACHINE FOR FORMING STRENGTHENED TUBULAR-WOVEN PRODUCTS

TECHNICAL FIELD

The present invention relates to a heald frame weaving machine for manufacturing a tubular-woven product, for example forming wire. The weaving machine which comprises upper and lower plies turning fold areas and in which weft threads can be guided through sheds formed by warp threads.

BACKGROUND OF THE INVENTION

It is previously known to weave tubular-woven material in heald frame weaving machines which operate using bobbin shuttles for drawing the thread of the weft through sheds formed by the warp threads. It is also known to weave flat-woven material which is removed from the machine and then folded and seamed at its free ends. The woven material thus extends in the longitudinal direction of the warp threads and the tubular-woven material is established by seaming the free ends of the warp threads. The joining together has been performed in the sewing department. The joining together work is carried out in a seam area which is extended in the longitudinal direction of the warp threads, and it is known to distribute the exit positions of the warp thread ends in the seam area so that there is a strong join. With known equipment, the weaving of the flat-woven cloth is carried out in a weaving machine which may be erected in a weaving hall. The joining together or bringing together of the warp thread ends is carried out in a sewing hall, to which the woven material is transferred. In connection with this, use is made in a known manner of stretching equipment in order to heat-treat and stretch the woven material to make the joining together work possible.

SUMMARY OF THE INVENTION

There is a requirement to increase the degree of automation in the manufacture of tubular-woven material while retaining great strength in the turning fold area. In this respect, for example, it is desirable to eliminate all or parts of the work in the sewing hall. At the same time the automated woven-material manufacture makes it possible for the tubular-woven material produced to have essentially the same strength around the entire circumference. The invention aims to solve this problem.

The use of tubular weaving with bobbin shuttles leads to quality problems because the tension in the weft threads cannot be kept uniform and appropriate for the purpose, which involves different tension effects on the outer warp threads. The invention solves this problem by providing a new method within the art. Thus, instead of carrying out the seaming function on the warp thread ends, it is performed on the weft thread ends.

It is very desirable that the new facilities can be implemented using well tried technology and with out too extensive conversion or structural modification of existing heald frame weaving machines. The invention solves this problem also.

According to the present invention, it is possible, in the case of each turning fold in the tubular-woven material, to retain a relatively extended turning fold area which extends across the warp threads, and the terminating positions of the weft threads are to be separated so that weaknesses do not arise in the seam. The invention solves this problem also.

According to the present invention, the terminating positions are treated as a pattern which is to be selected using existing program controls (punched card controls) in order to provide optimum or adequately great strength in the turning fold seam. The invention solves this problem also in a technically simple manner.

Previous methods, arrangements and applications have led to the stretching function having to be used twice, once before the joining together work in order to stabilize the warp thread ends which can be joined together, and then afterwards in order to obtain a check on the joining together work carried out. There is a requirement to reduce the use of the stretching arrangement when its use involves a complicated mounting function. The invention solves this problem.

The adjustment work involved in automation in the sewing department is extensive and can only be carried out on long tubular-woven materials. There is a requirement to simplify manufacturing in the case of tubular-woven materials in small series. The invention solves this problem.

There are problems associated with obtaining satisfactory controls of the weaving machine arrangement. The invention solves this problem also.

A heald frame weaving machine according to the invention to be is characterized by the fact that, among other things, its warp thread set is divided into a first warp thread set which is involved in producing the upper and lower ply in the product and, located at the side of the first warp thread set, second and third warp thread sets which are involved in producing the turning fold areas of the tubular-woven material, and in that weft threads guided through in the shed formations of the warp threads can be cut off at their respective ends by means of cutting-off members. Further characteristics are that the ends of the weft threads are arranged so as to adopt positions which are spread out in the respective turning fold area in a direction which coincides with the longitudinal directions of the weft threads. Furthermore thread-end-guiding members located in association with the turning fold areas are arranged so as, in a case when a cut-off weft thread originating from the upper or lower ply is assigned a terminating position for its end which is located in the turning fold area of the lower or, respectively, upper ply, to guide the cut-off weft thread around a warp thread lying outside and if appropriate through or between warp threads lying outside.

A preferred embodiment of the invention includes the feature that the shed formation function of the heald frame weaving machine effects the terminating position for the end of a weft thread when the latter originates from the same ply of the upper and lower plies comprises the turning fold area on which the terminating position is to be located.

In further embodiment of the invention, the respective members guiding the weft thread ends assign the respective weft thread a uniform thread tension on introduction of the weft thread end between its associated warp thread pairs in the second or third warp thread set. Gripper or nipper functions are arranged so as to cut off the respective weft thread at its both ends.

The gripper function can be arranged so as to interact with a further member which forms the thread-end-guiding member and can, for example, consist of a gripper member, air control arrangement etc. which guides a thread end belonging to the upper or lower ply in the second warp thread set in the shed formation for the second warp thread set to the relevant warp thread pair therein.

In an embodiment, the terminating positions in the respective turning fold area can be selected by means of program-controlled equipment which randomly spreads out the terminating positions in the respective turning fold area (turning fold area part) and/or operates with long series, in which terminating positions located next to one another, seen in the longitudinal direction of the weft threads, are prevented from appearing or are well distributed. The thread-guiding member(s) can assign weft thread pairs which belong together and belong to two cut-off weft threads following one another in the pattern an exit position between the same warp thread pairs or different warp thread pairs which are positioned one after another seen in the longitudinal directions of the weft threads.

By means of what is proposed above, benefits in terms of time are achieved by virtue of the fact that manual joining together of the woven upper and lower materials via loose warp thread ends in the sewing department can be avoided. The increased degree of automation is also brought about since fixing of the terminating positions for thread ends does not have to be carried out manually. The benefits of lower time consumption, in the case of tubular-woven products of, for example, a diameter of 25 meters and, for example, a length of approximately 6 meters, may be about 1–2 weeks, compared with previous manual procedures for joining threads together.

The work in the sewing department can be eliminated. The stretching arrangement now needs to be used only once because a separate stage for stiffening the thread ends can be eliminated. Members for guiding thread ends are used in order to guide weft threads or the lower ply to a turning-seam area located on the lower or, respectively, the upper ply. In this respect, the arrangement allows uniform tension distribution in drawing around the outer warp thread(s). The arrangement also allows the use of separate seam threads between positions in the upper and lower ply. Patterning of the terminating positions in the respective turning fold area can be controlled randomly by a program.

BRIEF DESCRIPTION OF THE DRAWINGS

A presently proposed embodiment of the new heald frame weaving machine will be described below with simultaneous reference to appended drawings, in which.

DETAILED DESCRIPTION OF THE PREFERRED EMBODIMENTS

Figure 1:
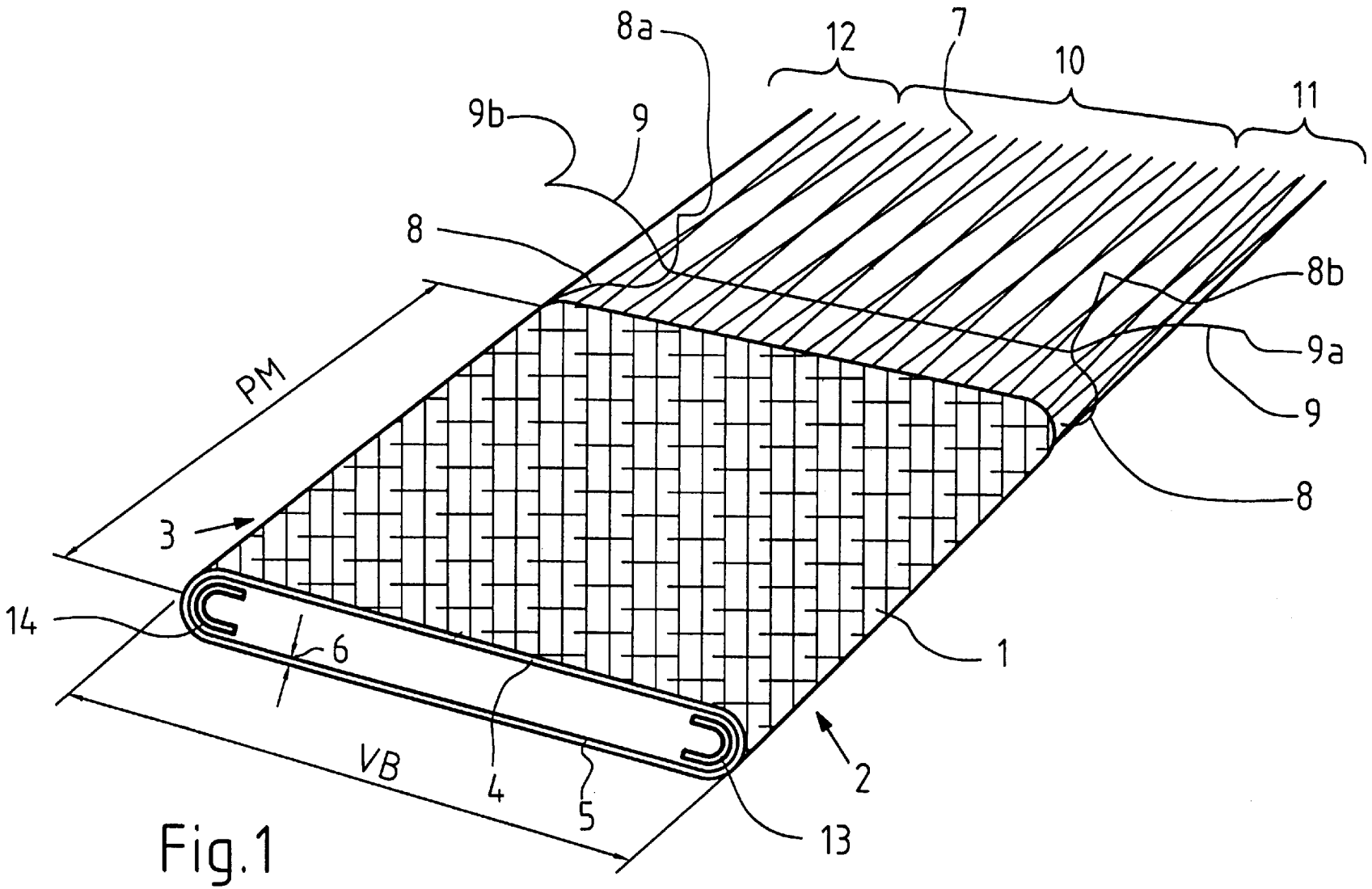
FIG. 1 shows a perspective view at an angle from above on the right of a tubular-woven material in the course of production, warp threads which are arranged so as to form sheds being obtained from a heald frame weaving machine and shoots of the weft or weft threads, which can be cut off, capable of being drawn through the sheds in the transverse direction of the warp threads.

In FIG. 1, a tubular-woven product is shown in principle by 1, the weaving width of the product being indicated by VB and the weaving length of the product being indicated by PM. The invention relates primarily to the weaving of products with weaving widths of 18 meters and weaving lengths of 12 meters. The product may consist of tubular-woven material intended for use in paper machines. It is important that the tubular-woven product is of high quality and great strength around the entire circumference. In this context, great strength means essentially the strength that is found in the case of conventional flat weaving and joining together in the sewing department. The product is woven in a heald frame weaving machine with grippers, which means that the upper and lower woven cloths obtained can be seamed at the sides 2 and 3 via the weft threads in the material.

The product 1 in the form of a tubular-woven material shown in FIG. 1 is in the course of being woven. The tubular-woven material comprises two turning fold areas 2, 3 which unite upper and lower plies 4, 5 in principle flat-woven and having a thickness 6. Each ply can consist of a double layer of warp threads lying one above another and a binding thread for these and also the weft threads. Warp threads, which extend in the longitudinal direction of the product 1, are symbolized by 7. In a known manner, the weaving machine operates with a shed formation function and weft threads are shot through or drawn through the respective sheds in the transverse direction of the warp threads. The weaving machine is also provided with gripper and cutting-off members (not shown in FIG. 1) on each side. The cutting-off members cut off at both its ends each thread that has been shot in or drawn through. Cut-off weft thread ends are brought together in the pattern so that the finishing end of a thread that has been shot in and cut off is arranged in association with the starting end of the following thread, etc. In FIG. 1, cut-off weft threads are indicated by 8 and 9 and the ends of the threads by 8*a*, 8*b* and 9*a*, 9*b*. In a preferred embodiment, the thread end 8b can be brought together with the end 9*a* of the preceding weft thread 9, etc.

In FIG. 1, the warp thread mat in a heald frame weaving machine of conventional type is divided into three parts. A first part is shown by 10. A second part is indicated by 11 and a third part by 12. The shed formation functions of the heald frame weaving machine in the three parts are coordinated so that sheds are established for the weft threads 8, 9 in each machine stroke. According to the invention, the warp thread parts 11 and 12 are used for the seam location areas at the sides 2 and 3 of the woven product 1. The seam location areas are also referred to here as turning fold areas. The invention is characterized in that each turning fold area is relatively extended. In FIG. 1, the extent of the turning fold areas has been symbolized by arrows 13 and 14 pointing in two directions. Each turning fold area comprises, seen radially, approximately 450 warp threads in width in the embodiment shown. Each turning fold according to FIG. 1 consists of two parts arranged one above another, one located on the upper ply and one on the lower ply, each part being approximately 450 warp threads wide.

Figure 2:
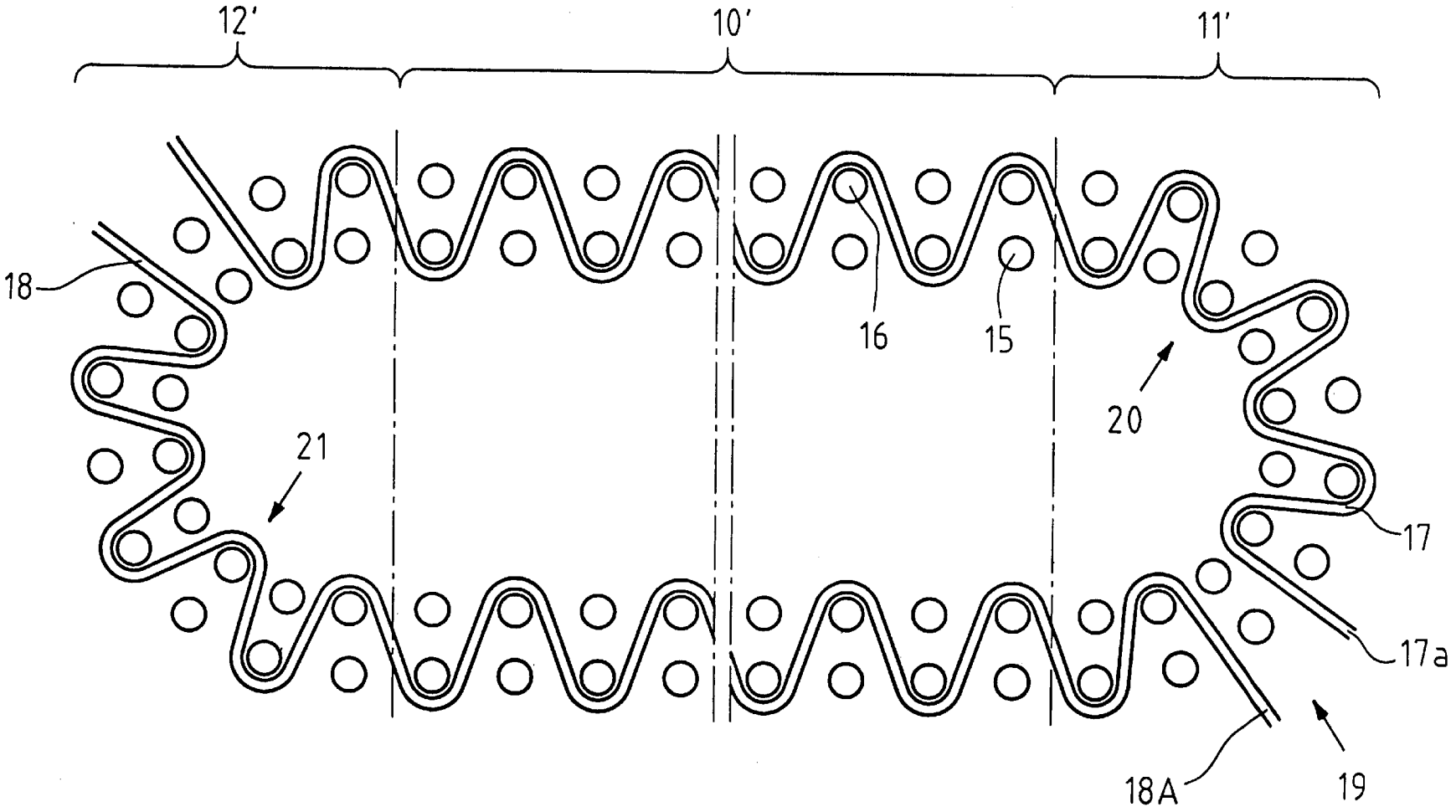
FIG. 2 shows in a cross section examples of the mutual relationship between warp threads and weft threads in connection with the seam or turning fold areas and the areas which are in principle flat-woven.

According to FIG. 2, in the woven product, which in the cross section concerned is composed in the longitudinal direction of two warp thread layers 15 and 16 around the cross sectional circumference shown, weft threads 17 and 18 are drawn through. The binding thread is not shown in this example. The thread ends 17*a* and 18*a* can be brought together in a first terminating position or a first changing location 19. In FIG. 2, a changing location or terminating position for two second threads (not shown) is indicated by 20 and a changing or terminating location for two third threads is shown by 21, etc. The changing locations or terminating positions 19, 20 and 21 are located in the turning fold areas 11' and 12'. The area 10' does not have any such changing locations or terminating positions. The weft thread ends 17*a*, 18*a* can be given a terminating position between the same warp thread pairs or warp thread pairs following one another in the tubular-woven material. Here, the term warp thread pair means the warp thread pair in the lower or upper layer. In this respect, each thread end is led out through both the lower layer of warp thread pairs and the warp thread pairs of the upper layer. In the present case, the warp thread pairs of the upper and lower layers have a common warp thread. Alternatively, the respective weft thread ends which are to be brought together or arranged in association with one another can extend through the same warp thread pairs or through warp thread pairs located at a relatively great distance from one another. Moreover, in one embodiment, the thread end parts can be drawn past one another, so-called cross-laying. In this case, each thread end passes the warp thread pairs of the other thread end, seen in the circumferential direction.

Figure 3:
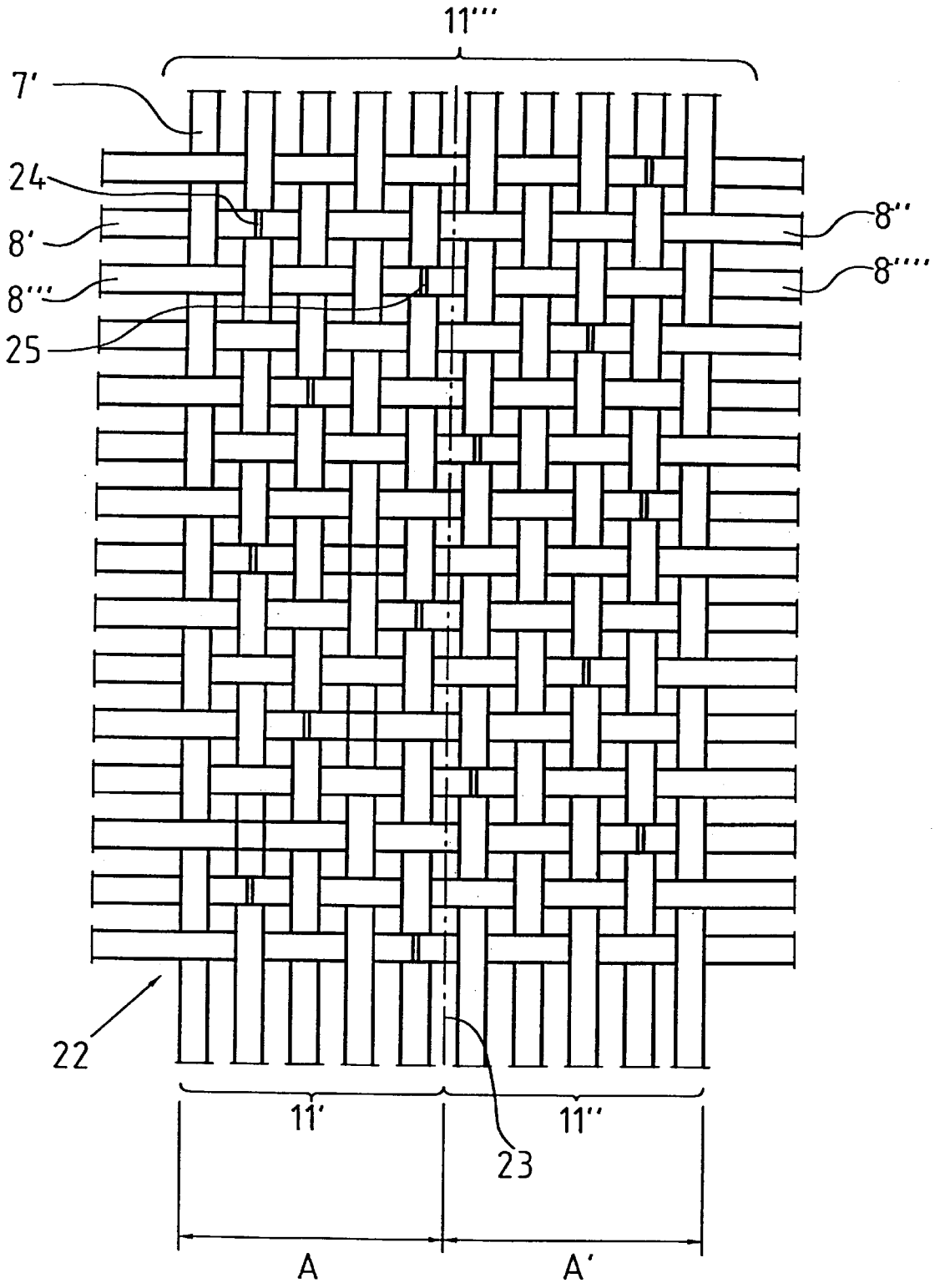
FIG. 3 shows a horizontal view of parts of a turning fold area spread out in the horizontal plane.

In FIG. 3, parts 22 of a turning fold area are shown spread out in a horizontal plane. The warp threads are represented by 7' and the weft threads by 8', 8" and 8'", 8"". An edge line through the turning fold area in the direction of the warp threads is indicated by 23. The turning fold area 22 consists in principle of two parts 11' and 11" lying one above the other, which thus, according to FIG. 1, are served by the warp thread mat parts lying outside. In FIG. 3, the total extended width has been indicated by 11'". The part 11' thus belongs to the upper cloth and the part 11" to the lower cloth (see also the arrows 13 in FIG. 1). FIG. 3 also shows the terminating positions (changing locations) for the various thread ends which have been or can be brought together. A first terminating position for the weft threads 8', 8" is thus shown by 24, a second terminating position for the threads 8'", 8"" by 25, etc. As seen in FIG. 3, some of the terminating positions come to be located on the first turning-fold part 11' which belongs to the upper cloth and other terminating positions come to be located on the second turning-fold part 11" which belongs to the lower cloth. By virtue of the fact that the terminating positions are not located essentially next to one another, for example along a line parallel to the edge line 23 in the extended turning fold area, but are spread out in the extended turning fold area, great strength is obtained in the woven material in the seams at the sides 2 and 3 (see FIG. 1). From the edge line 23, the turning fold areas extend over distances A, A' over the woven material (see above). The distances A, A' are preferably the same. Alternatively, only that part of the turning fold which is located on the upper or lower side may be used to comprise the terminating or exit positions for weft thread ends. The turning-fold part of the upper ply is preferably used. The above means that weft threads which run from the upper or lower ply and are assigned a terminating position on the lower or, respectively, the upper ply are to be laid around and if appropriate threaded between warp threads lying outside. This is an important feature of the invention and is described in greater detail below.

As an example of a heald frame weaving machine, reference is made to the TM300 machine offered for sale on the market by TEXO AB, Sweden. As the operation of the heald frame weaving machine is well known, it is not described in greater detail here.

In the present invention, the heald frame weaving machine is controlled so as to contribute to the "patterning" of the abovementioned terminating positions. By distributing the terminating positions according to a given pattern, optimum or great strengths can be achieved in a technically simple manner which moreover, by virtue of the fact that the entire seaming process for the tubular-woven wire takes place in the heald frame weaving machine, increases the degree of automation. The manual thread-tying work in the sewing department is eliminated completely and machine standstill times are radically reduced. The pattern for the terminating positions can be selected randomly control by equipment close to or in the machine or according to a given predetermined pattern which guarantees great strength. The warp thread layers in the respective ply can, for example, be made with different quality. Each bobbin used can be provided with its own load cell function for fixing the warp thread tension in the system.

Figure 4:
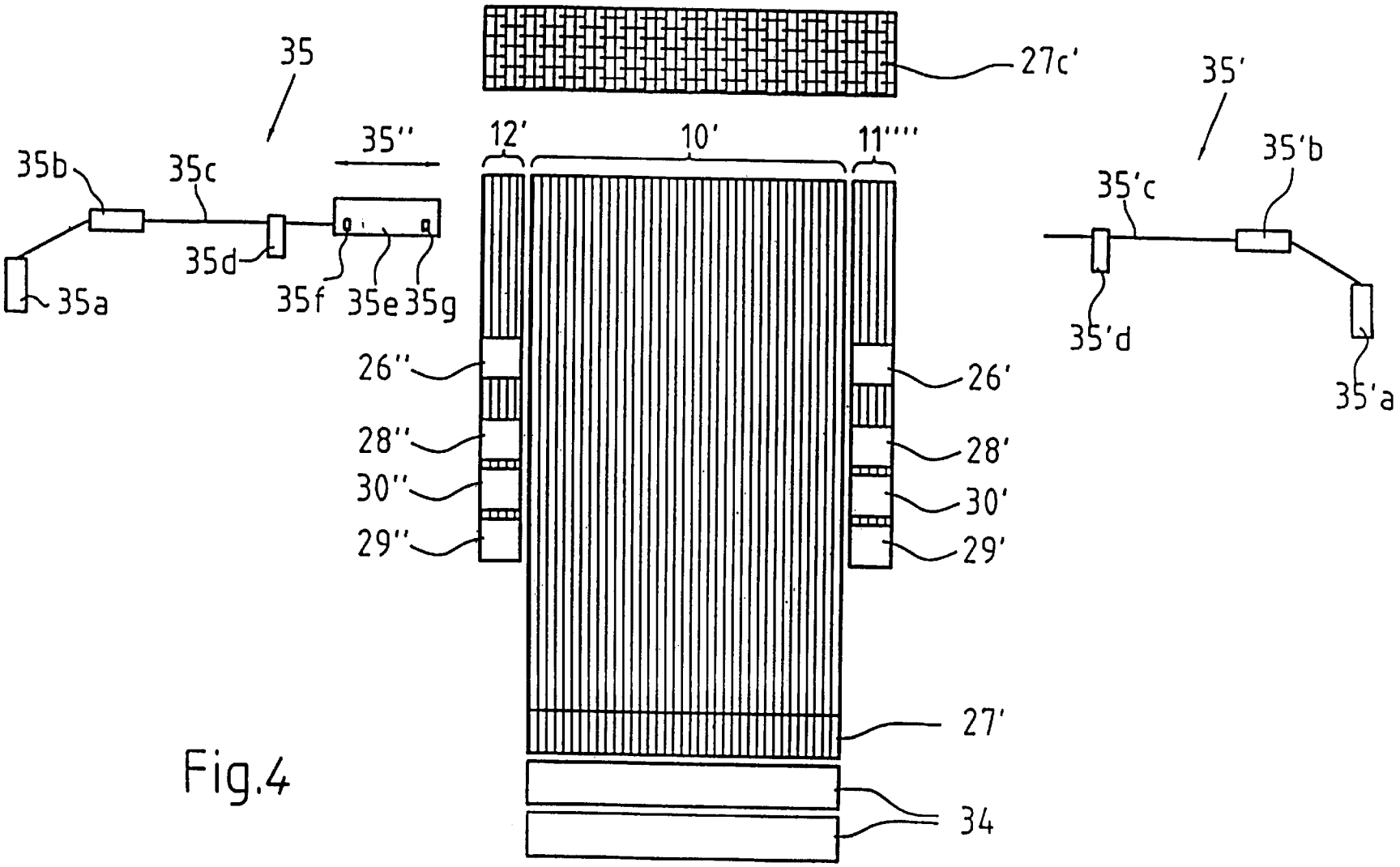
FIG. 4 shows from above parts of the weaving machine arrangement with a heald frame weaving machine and Jacquard machines.

FIG. 4 shows that accessory equipment 26' and 26" respectively is arranged on each side (and slightly in front of) the heald frame machine 27' which supplies a first warp thread set 10' from one or more bobbins 34 in a known manner. According to the above, the accessory equipment serves the second and third warp thread sets 11"" and 12' of the heald frame weaving machine. All the warp threads are fed in on a common cloth beam or a common cloth beam system 27*c'*.

The machine arrangement comprises equipment 35, 35' for delivering weft threads on both its sides. Each set of equipment includes a spool 35*a*, 35'*a*, a feedwheel unit 35*b*, 35'*b*, a weft thread 35*c*, 35'*c* and a gripper 35*d*, 35'*d*. A shuttle 35*e* with nippers 35*f*, 35*g* for cutting off the weft thread is shown currently adopting a position on one side of the arrangement. The equipment 35, 35' described is known as far as its construction and function are concerned and will therefore not be described in greater detail here. The direction of travel of the shuttle is symbolized by 35".

An air box unit or a projectile-firing arrangement of known type may also be included. Furthermore, an inner expander arranged in, on or close to the machine is also included in principle.

The heald frame weaving machine is an essentially known heald frame weaving machine which has been made with minor adaptations in the controls that are to be executed and the heald frame weaving machine, in addition to patterning the woven material, also carries out patterning of the locations of the terminating positions in the turning fold areas. Thread-guiding members which guide a thread end of a weft thread in the upper or lower ply to a terminating position in the turning-fold part of the lower or, respectively, upper ply are furthermore to be included.

Figure 5:
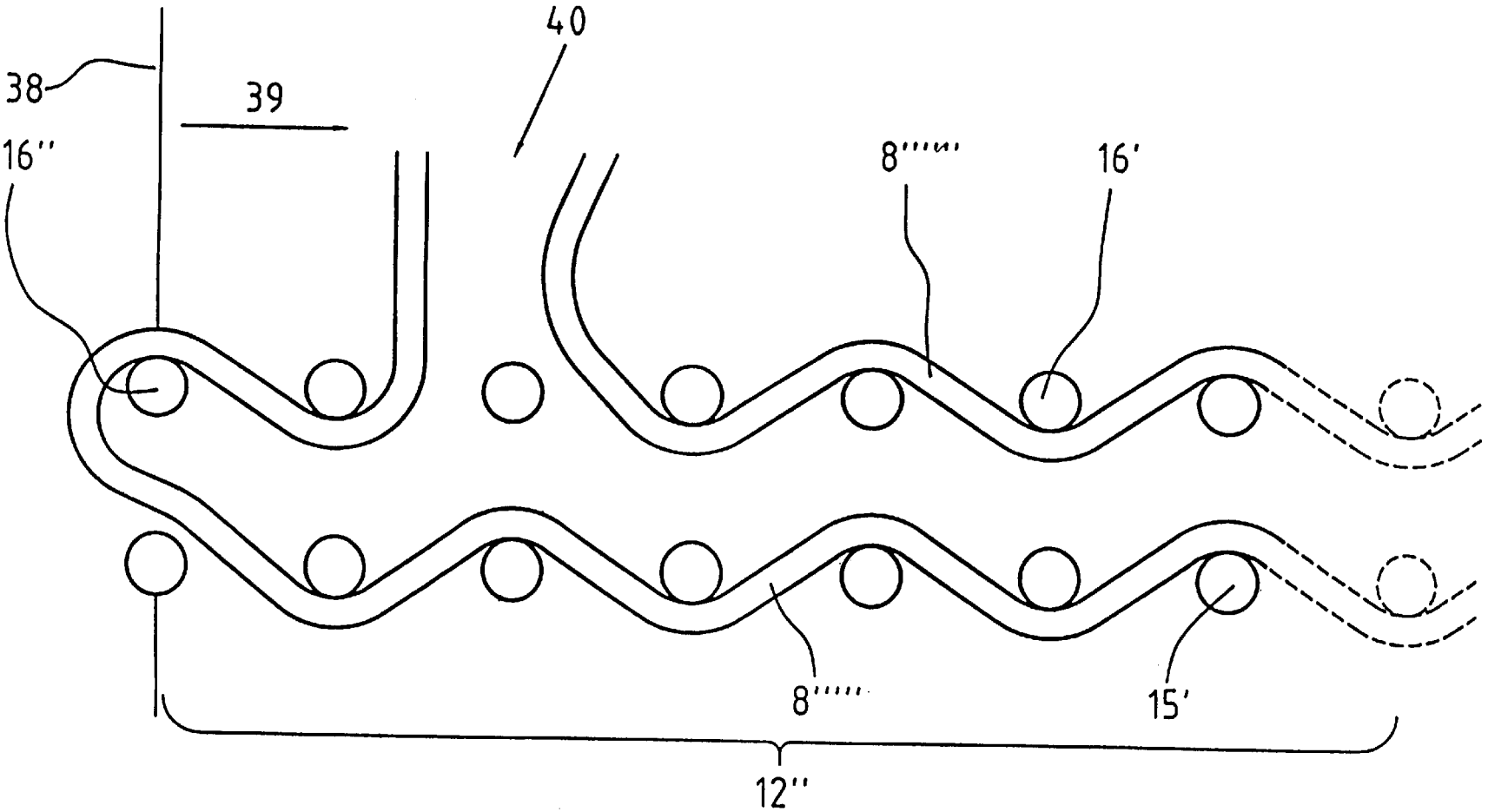
FIG. 5 shows in cross section the drawing of the weft threads in the warp threads in a turning fold area.

In order to simplify the description of the invention, FIG. 5 indicates an upper and lower ply with one layer of warp threads each and shows in principle a turning fold area in which, in the lower cloth warp 15', a weft thread 8'"" has been drawn through all the warp threads and, in the upper cloth warp 16', the weft thread 8'"" has been drawn out between the third and fourth warp thread from the outer edge 38 or the outer warp thread 16". In this connection, the thread is laid around the outer warp thread 16" and is guided in inwardly according to the weaving pattern in the direction 39 to the joining together location 40 between warp threads 16'" lying inside in the joining together function. This function is performed automatically in the present arrangement.

Figure 6:
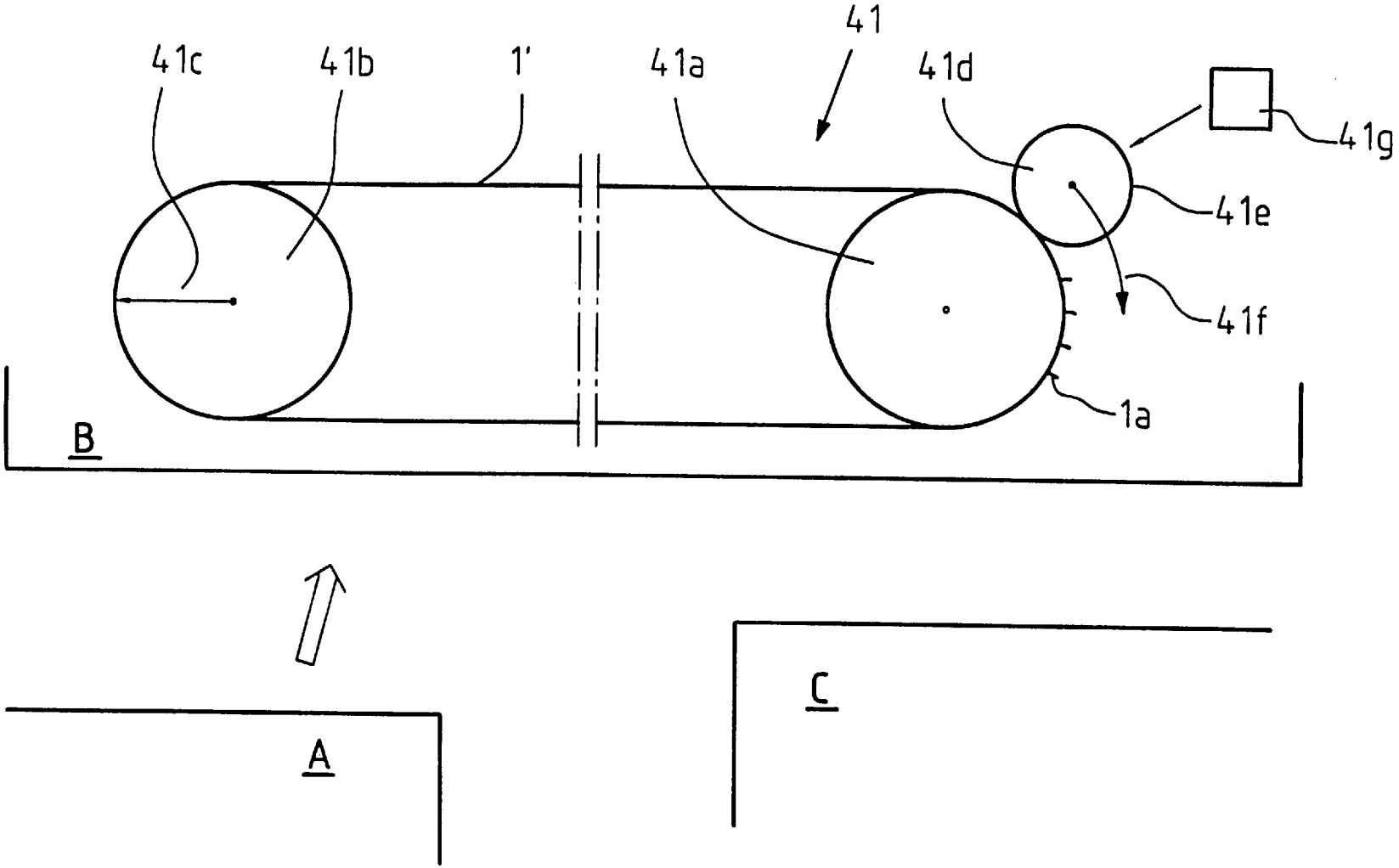
FIG. 6 shows parts of a stretching arrangement with heat action members in association with a weaving machine for tubular-woven material.

FIG. 6 shows in principle a stretching present arrangement 41, in which a tubular-woven material 1' is stretched by means of rollers 41*a*, 41*b*. The latter can be displaced in relation to one another (see arrow 41*c*) and can be opened so that the woven material can be mounted on and removed from the rollers. The thread fringe(s) on the tubular-woven wire, which is (are) a result of the thread ends described above projecting from warp thread pairs at terminating locations, is (are) removed, for example by cutting off. A heat-supplying member 41*d* is arranged close to one or both the rollers. The member may be in the form of a roller with a heatable surface 41*e*. The roller member 41*d* can be rolled or guided along periphery of the respective roller 41*a* and/or 41*b* concerned in the direction of the arrow 41*f*. The heat-supplying member 41*g* is arranged so as to transmit heat to or generate heat on the surface 41*e* of the roller 41*d*. The roller 41*d* can be pressed against the roller 41*a*, 41*b* concerned with the woven material produced lying in between and can thus interact with thread ends and surrounding material in the turning fold area(s) (see 2, 3 in FIG. 1). In this connection, the heat emission is selected so that the thread material(s) undergo(es) a known heat action for stiffening the woven material. By means of the heat action, the thread ends are integrated with the surrounding warp thread and weft thread material so that the strength is achieved. Temperatures selected may be of about 185° C. In an exemplary embodiment, heat transmission may take place by means of contactless heat radiation. In an exemplary embodiment, the product woven in the weaving machine arrangement can therefore be introduced directly from the weaving hall A into the stretching arrangement B without going via the sewing department C, which has a positive effect in terms of rationalization and automation (see above).

Figure 7:
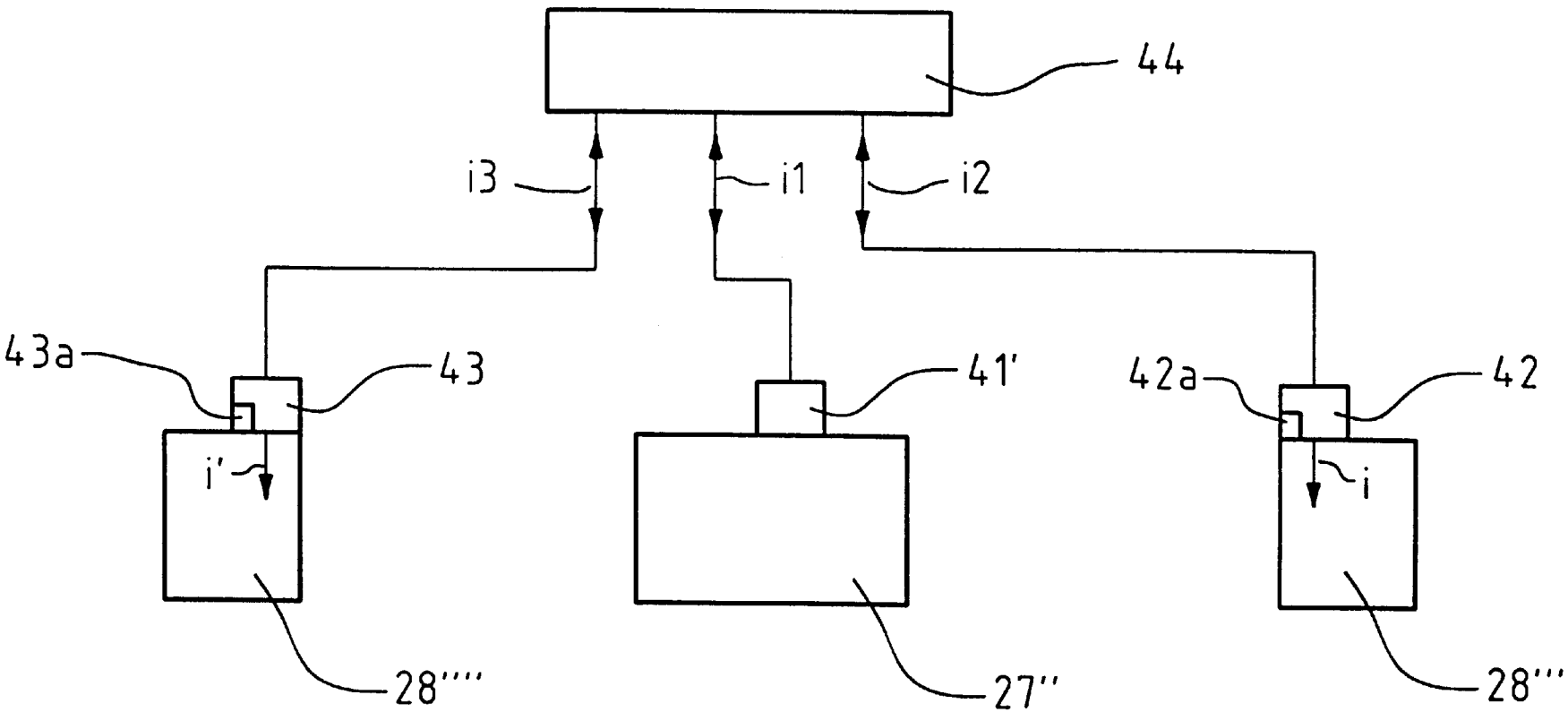
FIG. 7 shows in the form of a basic diagram a control unit arrangement for the weaving machine arrangement.

FIG. 7 shows the control functions for the heald frame weaving machine 27" and members guiding the weft thread ends or the accessory equipment 28'" and 28"" referred to above. Each member/set of equipment is arranged with a signal control unit 41' and 42, 43 respectively which can be controlled from an operating unit 44 for the heald frame weaving machine. Alternatively, the units 41', 42 and 43 can be positioned in or close to the unit 44. The members/sets of equipment are controlled using known software in order to establish "pattern formation" for the terminating positions of the weft threads and also patterning of the woven material in the turning fold areas. The heald frame weaving machine is controlled using known software for establishing the pattern for the upper and lower cloths (the wires) which are in principle flat-woven. A pattern control function corresponding to the pattern control function of the heald frame machine is incorporated into the pattern program of the members/accessory equipment so that the woven material is provided with the same pattern in the upper and lower parts and in the turning fold areas. This interaction of the software can be effected in a known manner. Control of the pattern in question in the tubular-woven material and adjustment of the pattern for the terminating positions in the turning fold areas can be effected from the control unit 44 and/or separately from the units 41', 42, 43 in addition. For forming the pattern for the terminating positions, use can be made of a random generator function which is symbolized in FIG. 7 by 42*a* and 43*a* respectively. Patterns for the terminating positions may be the same in both turning fold areas or may differ. What is important is that strong turning folds are obtained in the machine arrangement.

By means of what is proposed above, a tubular-woven forming wire is obtained, a gripper system also being included. As mentioned above, the manufacture of the whole product in the heald frame weaving machine leads to a saving of 2 weeks in the manufacture of the forming wire which can now be manufactured in a third of the time previously required. There is thus a considerably greater degree of automation or rationalization and the increased degree of automation bears comparison in this respect with that found when it is necessary to splice the warp threads of the woven material in the turning folds in the sewing department. In FIG. 4, the grippers have been symbolized by 35*d* and 35*d*' respectively. In FIG. 7, the control of the respective accessory equipment 28'" and 28"" by the control units 42 and 43 has been symbolized by i and i' respectively. The control functions between the unit 44 and the units 41', 42 and 43 have been symbolized by i1, i2 and i3.

Figure 8:
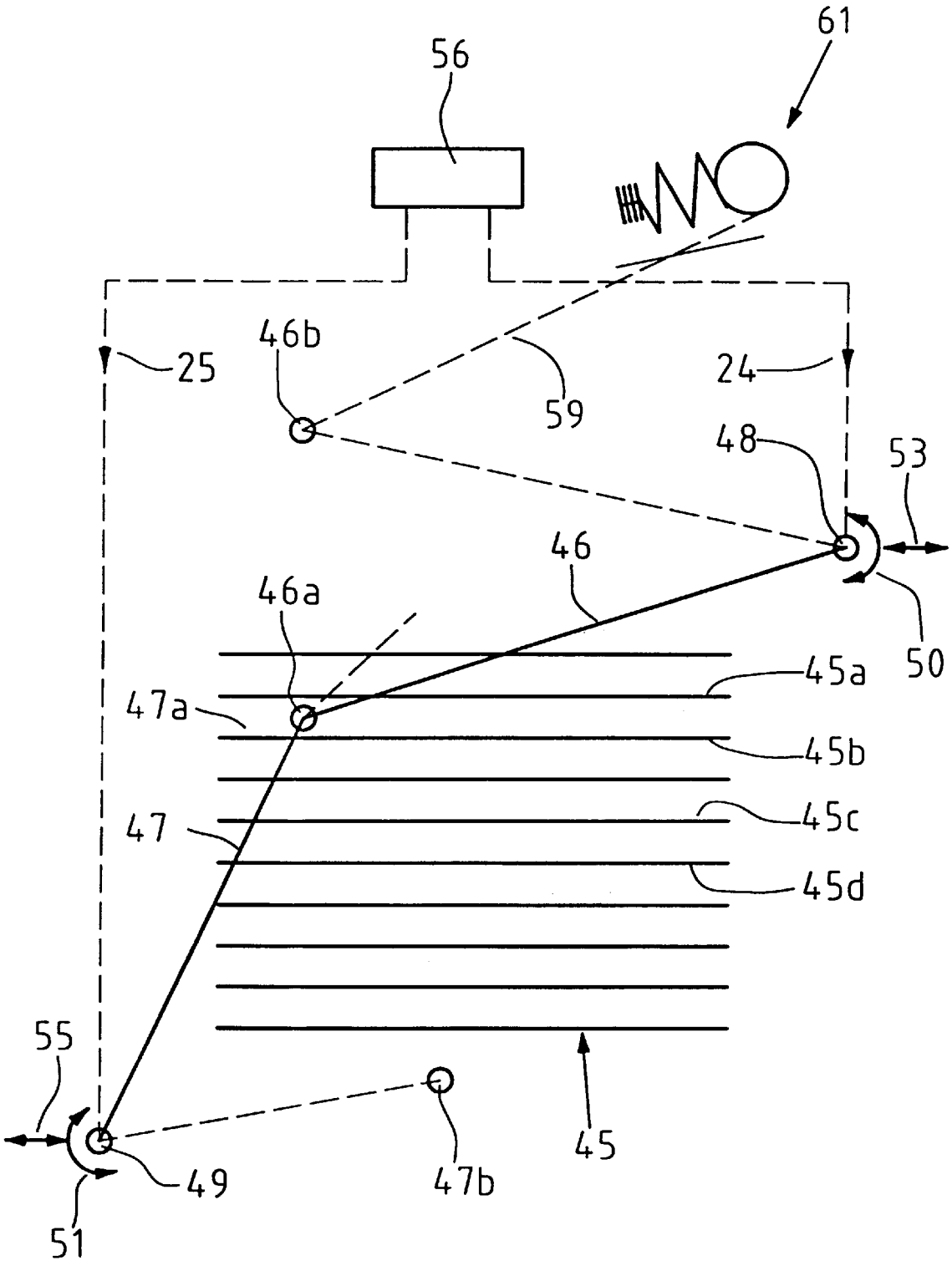
FIGS. 8 and 8*a* show in principle thread-end-guiding members in horizontal and, respectively, vertical views.
Figure 8A:
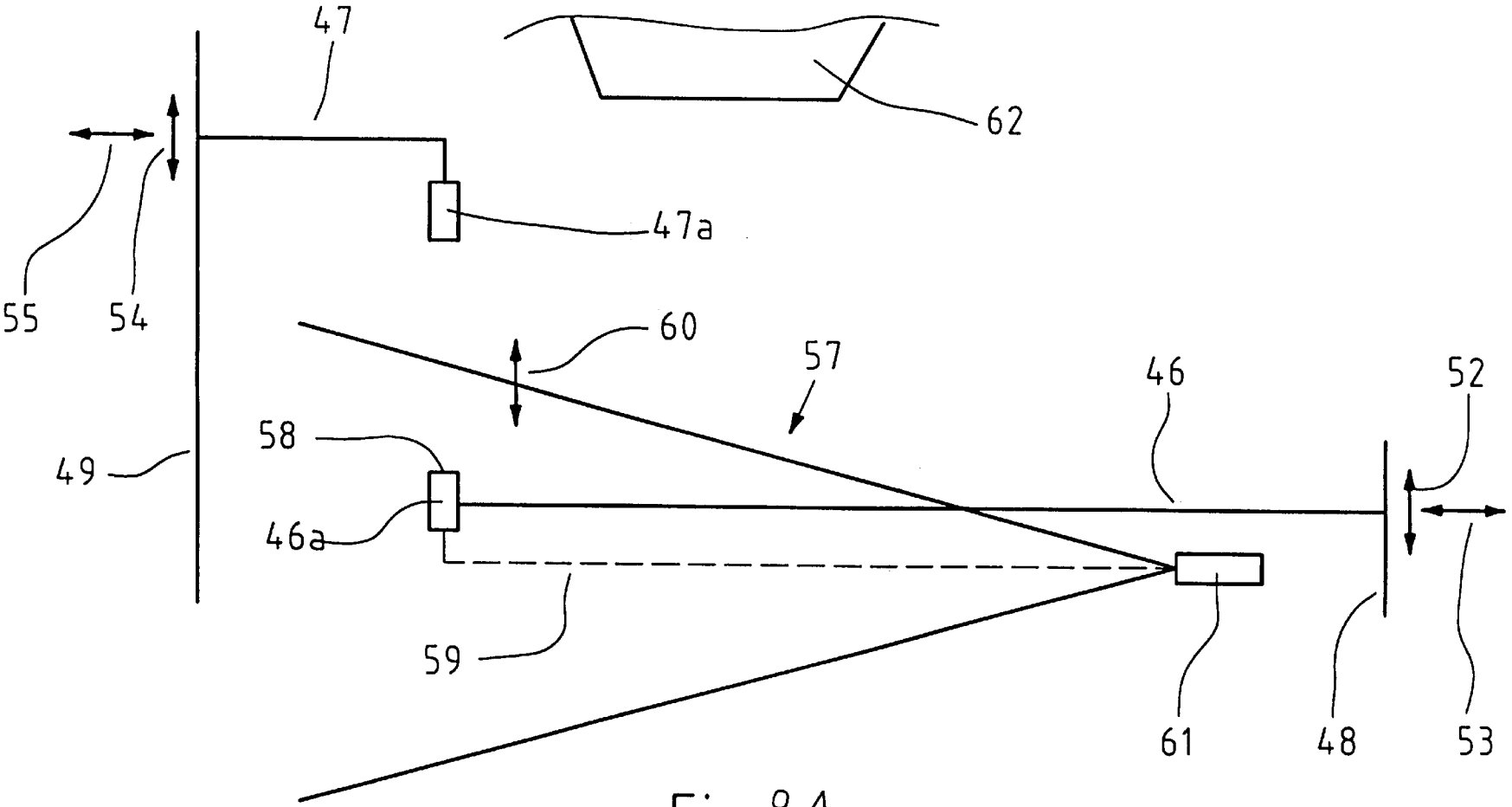

FIGS. 8 and 8*a* show examples of thread-guiding members or accessory equipment operating in association with shed formation for warp threads 45. In the exemplary embodiment, the members comprise two pivotable arms 46, 47. The arms are pivotable on bearing spindles 48, 49 in the directions of the arrows 50, 51. The spindles 48, 49 are furthermore arranged displaceably in directions 52, 53 and, respectively, 54, 55 at right angles to one another. Operation of the spindles, that is to say the arms 46, 47, is effected from the control unit 56 which can form the control unit for the arrangement. The pivot arms have members 46*a*, 47*a* which can interact with thread ends and which can be moved to the positions shown by solid lines in FIGS. 8, 8*a* and to different positions, for example the positions 46*b*, 47*b* shown by broken lines. The former positions are located inside the warp thread shed and the latter positions are located at the side of the warp threads. In the latter positions, the pivot arm 46 has, with its member 46*a*, caught one end 58 of a weft thread 59 and guided it into the shed 57. Depending on controls or electric control signals i4, i5 etc., the thread end can be guided into the shed and placed opposite a space between a pair of warp threads, for example the warp thread pair 45*a*, 45*b*. The pivot arms are moved in directions 60 away from and towards one another.

When the interacting members 46*a*, 47*a* are moved so that they are placed opposite one another in the vertical direction, they are actuated so as to move towards one another by control from the unit by the signals i4, i5 etc. so that the member 47*a* can enter into interaction with the member 46*a* and, by means of a known take-over function, take the thread end over from the member 46*a* and draw it up between the warp thread pair 45*a*, 45*b*, above which it releases its grip on the thread end if the latter has reached its final position. If this is not the case, the pivot arms can be moved further by the unit into the warp thread shed, for example to the space between the warp thread pair 45*c*, 45*d*, the member taking over, in a corresponding manner, the thread end from the member 47 etc. until the correct/desired position has been reached for the thread end in question. The weft thread is fed in via member(s) 61 for defining the thread tension, by means of which a uniform desired tension can be maintained throughout the course of the seaming process in the machine. In addition or as an alternative to the member 47, 47*a*, use can be made of an air suction arrangement 62 which can be of known type and by means of which the thread end can be sucked up between the warp threads. In this way, warp thread drawing can be effected in one ply and the turning fold is located in the other ply, or vice versa (see FIGS. 2, 3 and 5). The heald frame weaving machine operates with accelerated repetition so that the normal patterning of the woven material can also be carried out. Arrangements shown in FIGS. 8, 8*a* can be integrated with the gripper function in the heald frame machine.

The thread-end-guiding members are thus arranged so as, in a case when a cut-off weft thread originating from the upper or lower ply is assigned a terminating position for its end which is located in the turning fold area of the lower or, respectively, upper ply, to guide the cut-off weft thread around a warp thread lying outside and if appropriate through warp threads lying outside. The shed formation function effects the terminating position for the end of a weft thread when the latter originates from the same ply of the upper and lower plies as comprises the turning fold area on which the terminating position is to be located.

The invention is not limited to the embodiment shown above by way of example but can be modified within the scope of the patent claims below and the idea of the invention.

What is claimed is:

1. In a heald frame weaving machine for producing a tubular woven product, the tubular woven product including upper and lower plies connected by turning-fold areas and having weft threads extending through sheds formed by warp threads, the warp threads being divided into a first warp thread set used in forming the upper and lower plies and second and third warp threads sets, arranged on sides of the first warp thread set, used in forming the turning-fold areas, the improvement comprising:

cutting means for cutting the weft threads at both its ends; and thread-end guiding members for guiding the cut-off end of the weft threads originating in the upper or lower ply around an outer warp thread in an edge region of said turning-fold area to a terminating position in the turning-fold area of the lower or upper ply, respectively.

2. Heald frame weaving machine according to Patent claim 1, wherein a shed-formation function creates the terminating position for the cut-off end of a weft thread when the weft thread originates from the same ply of the turning-fold area on which the terminating position is located.

3. Heald frame weaving machine according to Patent claim 1, wherein the thread-end guiding members includes means for assigning the respective weft thread a uniform thread tension on introduction of the weft thread end between its associated warp thread pairs in the second or third warp thread set.

4. Heald frame weaving machine according to Patent claim 1, wherein a gripper is arranged to interact with a further member which forms said thread-end-guiding member, the further member guides a thread end belonging to the upper or lower ply in the second warp thread set in the shed for the second warp thread set to a warp thread pair therein.

5. Heald frame weaving machine according to Patent claim 1, wherein terminating positions in the turning-folded area are selected by program-controlled equipment which randomly spreads out the terminating positions in the turning-fold area whereby terminating positions located next to one another, seen in the longitudinal direction of the weft threads, are prevented from appearing or are well distributed.

6. Heald frame weaving machine according to Patent claim 1, wherein the thread-end-guiding member includes means to assign weft thread end pairs, which belong together and belong to two cut-off weft threads following one another in a weaving pattern, an exit position between the same warp thread pairs or different warp thread pairs which are positioned one after another in the longitudinal directions of the weft threads.

* * * * *